US008225976B2

(12) United States Patent
Meunier

(10) Patent No.: US 8,225,976 B2
(45) Date of Patent: Jul. 24, 2012

(54) BELT ASSEMBLY AND CONTAINER THEREFORE

(75) Inventor: Paul Meunier, Trois-Rivières (CA)

(73) Assignee: Les Entreprises Duckbill Inc., Trois-Rivières, Québec (CA)

( * ) Notice: Subject to any disclaimer, the term of this patent is extended or adjusted under 35 U.S.C. 154(b) by 973 days.

(21) Appl. No.: 11/686,051

(22) Filed: Mar. 14, 2007

(65) Prior Publication Data

US 2008/0223888 A1 Sep. 18, 2008

(51) Int. Cl.
*A45F 5/00* (2006.01)

(52) U.S. Cl. ..... 224/675; 224/672; 224/914; 224/901.8

(58) Field of Classification Search ..... 224/660, 224/663, 665, 671, 672, 675, 901.8
See application file for complete search history.

(56) References Cited

U.S. PATENT DOCUMENTS

| | | | | |
|---|---|---|---|---|
| 3,664,560 | A | 5/1972 | Perkins | |
| 4,063,313 | A | 12/1977 | Hagios | |
| 4,165,826 | A | 8/1979 | Chica | |
| 4,174,793 | A | 11/1979 | Wisowaty | |
| 5,464,136 | A | 11/1995 | Eddy | |
| 5,470,000 | A | 11/1995 | Munoz | |
| 5,570,824 | A | 11/1996 | Lyon et al. | |
| 5,683,022 | A | 11/1997 | Evans | |
| 5,881,933 | A | 3/1999 | Rogers | |
| 6,015,073 | A | 1/2000 | Wojciak et al. | |
| 6,152,338 | A | 11/2000 | Smith | |
| 8,011,545 | B2 * | 9/2011 | Murdoch et al. | 224/672 |
| 2007/0033698 | A1 | 2/2007 | Long | |

FOREIGN PATENT DOCUMENTS

| | | |
|---|---|---|
| CA | 2254626 | 5/2000 |
| CA | 2354814 | 6/2002 |

* cited by examiner

*Primary Examiner* — Justin Larson
(74) *Attorney, Agent, or Firm* — Bereskin & Parr

(57) ABSTRACT

The present invention relates to a belt assembly and to a container therefore. The belt assembly includes an inner belt, a supporting belt and at least one container. The inner belt is adapted to be installed around a wearer's waist. The supporting belt is adapted to be cohesively affixed to the inner belt. The container is adapted to be affixed to the supporting belt and cohesively affixed to the inner belt. The container is adapted to carry equipment in a receiving compartment, and includes a fixating structure for affixing the receiving compartment to the supporting belt and cohesively affixing to the inner belt.

16 Claims, 6 Drawing Sheets

BELT ASSEMBLY AND CONTAINER THEREFORE

FIELD OF THE INVENTION

The present invention relates to a belt assembly and container therefore, and more particularly to a belt assembly and container for workers carrying equipment.

BACKGROUND OF THE INVENTION

In their daily work, many types of workers need to carry equipment with them. For doing so, different types of belt assemblies have been proposed in the prior art.

In the case of police officers, which need to carry a gun, a flashlight, pepper spray and sometimes other equipment as well, the typical belt assembly used is based on a thick leather belt, on which various containers are slid along. Although such belt assembly has proven its sturdiness over the years, it is not particularly convenient for fast removal of containers, as the leather belt is used to simultaneously support the containers, while passing through loops of a wearer's pants. Additionally, this type of belt assembly has been identified as the main cause of preventable back, hip and thigh injuries caused by poorly distributed and misallocated wearable weight. Because of its intrinsic mechanical properties, the thickness of leather belt has to be sufficient to support the equipment securely in various situations: standing, sitting, walking, running, etc. To prevent excessive lagging, the leather belt needs to be thick enough and thus is quite rigid, which is not comfortable when used in a sitting position, and adds pressure to a back of a wearer and may result in an injury.

Canadian patent no. 2,254,626 to Safariland Ltd. describes a track member system to carry equipment around a waist of a wearer. More particularly, this system is composed of an internal belt and an external belt equipped to affix containers. The internal belt and external belt are equipped with matching fabric loop/hoop, such as Velcro™, to allow a tight bonding therebetween. Containers can be affixed to the external belt, which is equipped of tracks. Both the external belt track system and container attachment are rigid. A clamp is used to secure the container in a specific position on the exterior belt. Although this track member system can be quickly removed, and the containers can be affixed to the exterior belt, such system is not comfortable in bending and sitting positions because of the rigidity of the exterior belt track system and containers.

Canadian patent no. 2,354,814 to Hand tools International describes a belt assembly for storing and inventorying tools. This assembly is composed of a belt onto which containers are slid. The belt is thus rapidly removable. However, the containers are free of sliding along the belt, which is not convenient for workers such as police officers or electricians when they store their gear between and after uses.

There is therefore a need for a belt assembly that is capable of carrying various types of interchangeable various types of containers and equipment more ergonomically, while being removable rapidly.

SUMMARY OF THE INVENTION

The present invention relates to a belt assembly and containers for use with that belt assembly. The belt assembly of the present invention allows ergonomic carrying of equipment, and fast removal thereof.

For doing so, a first aspect of the present invention relates to a belt assembly. The belt assembly includes an inner belt, a supporting belt and at least one container. The inner belt is adapted to be installed around a wearer's waist. The supporting belt is adapted to be cohesively affixed to the inner belt. The at least one container is adapted to be affixed to the supporting belt and cohesively affixed to the inner belt.

In another aspect, the present invention relates to a container for carrying equipment on a belt assembly, of the type including an inner belt and a supporting belt. The inner belt and supporting belt are being substantially covered with corresponding fabric of the hook and loop fasteners type for cohesively affixing onto one another. The container includes a receiving compartment and a fixating structure. The receiving compartment is adapted for carrying the equipment. The fixating structure is adapted for affixing the receiving compartment to the supporting belt and cohesively affixing to the inner belt.

BRIEF DESCRIPTION OF THE DRAWINGS

In the following description, the following drawings are used to describe and exemplify the present invention.

DETAILED DESCRIPTION OF THE INVENTION

The present invention relates to a belt assembly and a container that is more ergonomic and more rapidly removable than prior art belt assemblies. For doing so, the present invention proposes a belt assembly in three separate units: an inner belt, a supporting belt, and a compartment. The inner belt is worn at a wearer's waist, while the supporting belt is adapted to cohesively affix to the inner belt. Each of the compartments is adapted to affix to the supporting belt, while cohesively affixing to the inner belt to carry hand tools, instrument and devices over long distances, for long period of time or awkward confined or dangerous spaces. This is referred to as the MaxCon concept.

The belt assembly of the present invention can be used by any worker having to carry equipment at the waist. Such workers include police officers, public safety, private security, homeland security, industrial maintenance professionals, institutional custodial workers, electricians, plumbers, telephone installers, cable installers, and all construction workers. Typically, such workers carry at their waist many kilograms of equipment unevenly or disproportionately. Because the weight of the equipment is generally carried on the side and on the front, many workers complain of back pain and postural problems. To overcome poor weight distribution of the equipment around the waist, many belt systems rely on rigid belts. Such solution may be acceptable for workers who work mostly in standing position. However, for workers having to wear their equipment at their waist for extensive period of times, and various upright, sitting and bent over positions, the use of rigid belts only increases the aches and pains of workers.

Therefore, the belt assembly of the present invention is preferably designed in such a manner as to be lighter and more flexible than prior art solutions. In another aspect, the belt assembly of the present invention also allows use of various types of interchangeable containers affixed in such a manner to the belt assembly so as to provide fast and continuous position of containers in between uses of the latter. Alternatively, in accordance with another aspect of the present invention, the belt assembly of the present invention is adapted for carrying equipment and is systematically convertible to use suspenders, utilizing the same interchangeable positioning and affixing mechanisms as the belt of the present invention.

Figure 1:
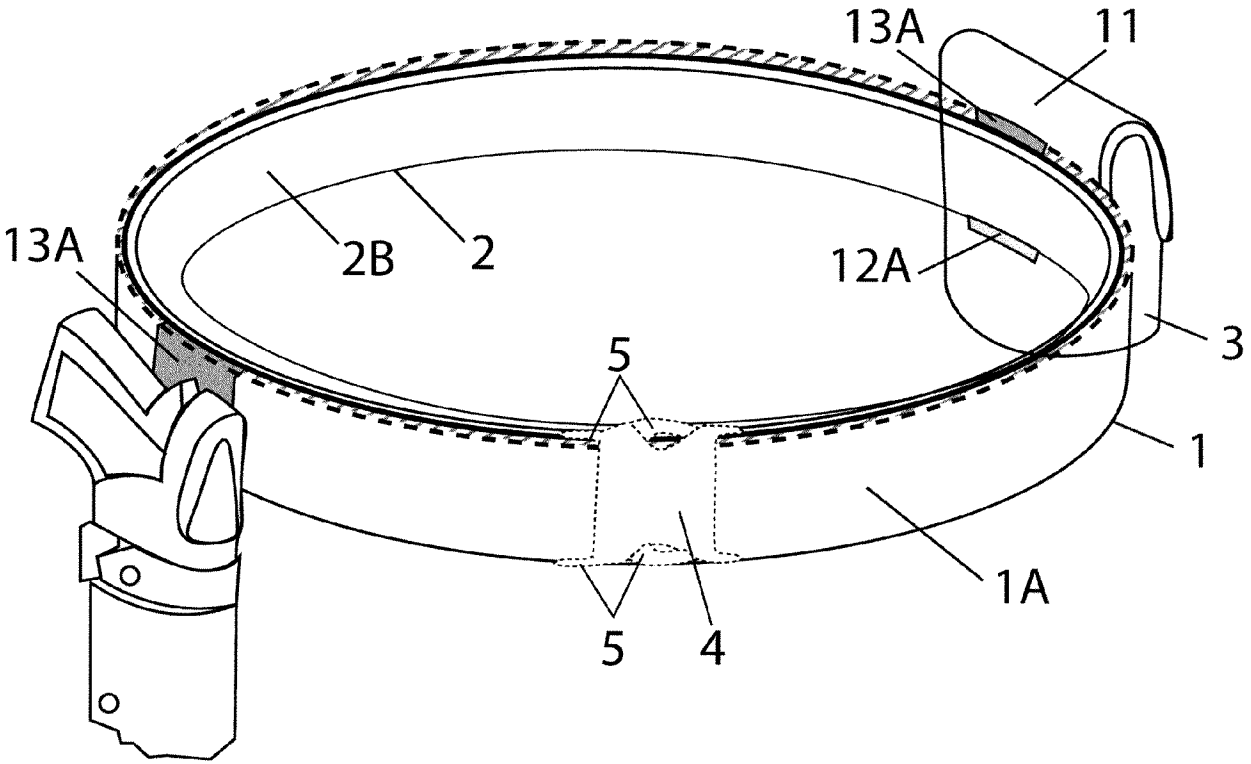
FIG. 1 is a perspective view of a belt assembly in accordance with the present invention.

Reference is now made to FIG. 1, which is a perspective view of the belt assembly 10 of the present invention. The belt assembly 10 includes an inner belt 12, a supporting belt 14, and containers 16*a* and 16*b*. The inner belt 12 is designed in such a manner that it is to be worn around a wearer's waist. The inner belt 12 may be designed of flexible material. The inner belt 12 has an exterior surface partially or completely covered with a fabric of the hook and loop fasteners type, such as for example Velcro™. The inner belt 12 is preferably designed in such a manner that it fastens on itself, without requiring any buckle, such as with the fabric of the hook and loop fasteners type. Width of the inner belt 12 can be adapted to fit various physiognomy, so as to add comfort to the wearer. For example, for a wearer of short torso, it may be desirable to use the inner belt 12 with a smaller width, while for a wearer of longer torso, the inner belt 12 may be designed of a larger width.

The supporting belt 14 is designed to cohesively affix to the inner belt 12. To perform such cohesive affixing, a cooperating fabric of the hook and loop type may be applied to an interior surface of the supporting belt. The fabric may cover only a longitudinal section of the interior surface of the supporting belt 14, or in a more preferable manner, covers the entire interior surface of the supporting belt. It could also be possible to design the fabric of the hook and loop type of the interior surface of the supporting belt 14 to correspond to the size of the fabric of the hook and loop type of the inner belt 12. In order to add to the comfort of the wearer, the supporting belt is also preferably designed in a material that it is laterally flexible while being longitudinally inflexible or unstretchable. An example of a fabric fulfilling such requirements, while providing additional comfort to the wearer is the fabric used for safety belts. Such fabric is light, durable, and laterally flexible while being longitudinally inflexible or unstretchable. These criteria are important for a supporting belt that will be worn for extensive hours, for carrying several kilograms of equipment, in various positions and conditions.

Figure 2:
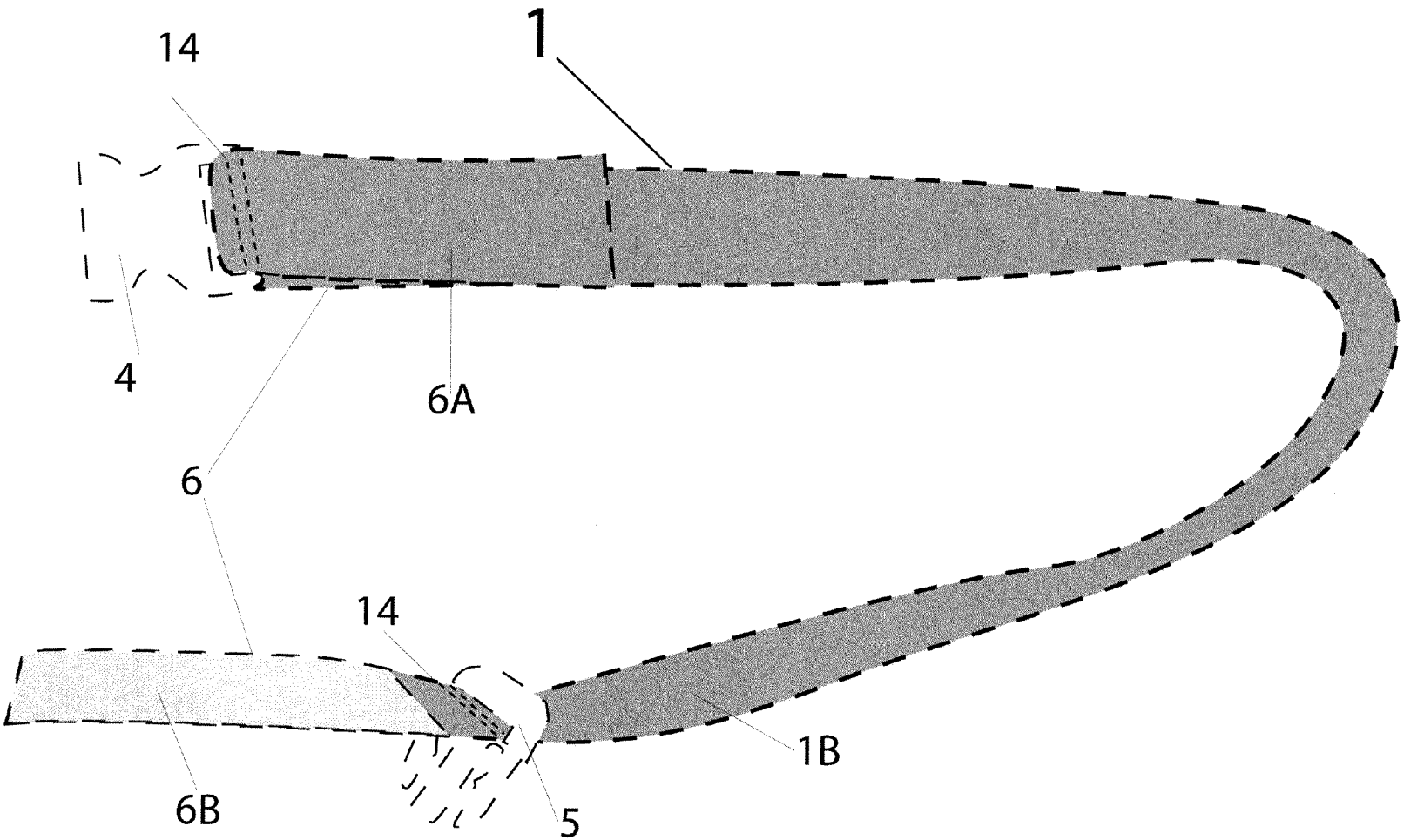
FIG. 2 is a perspective view of a supporting belt of the present invention.
Figure 3:
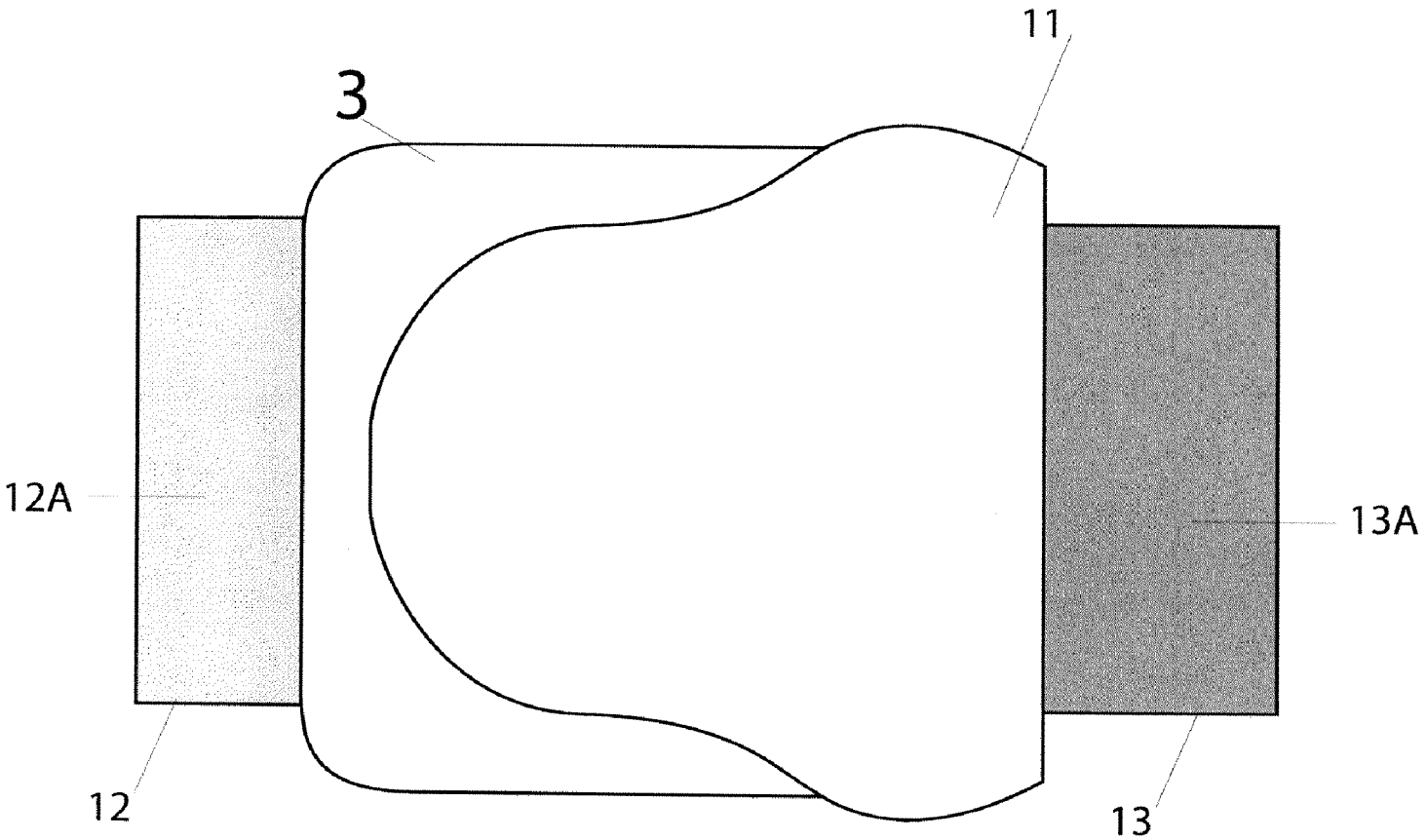
FIG. 3 is a front view of a buckle of the supporting belt of the present invention.
Figure 5:
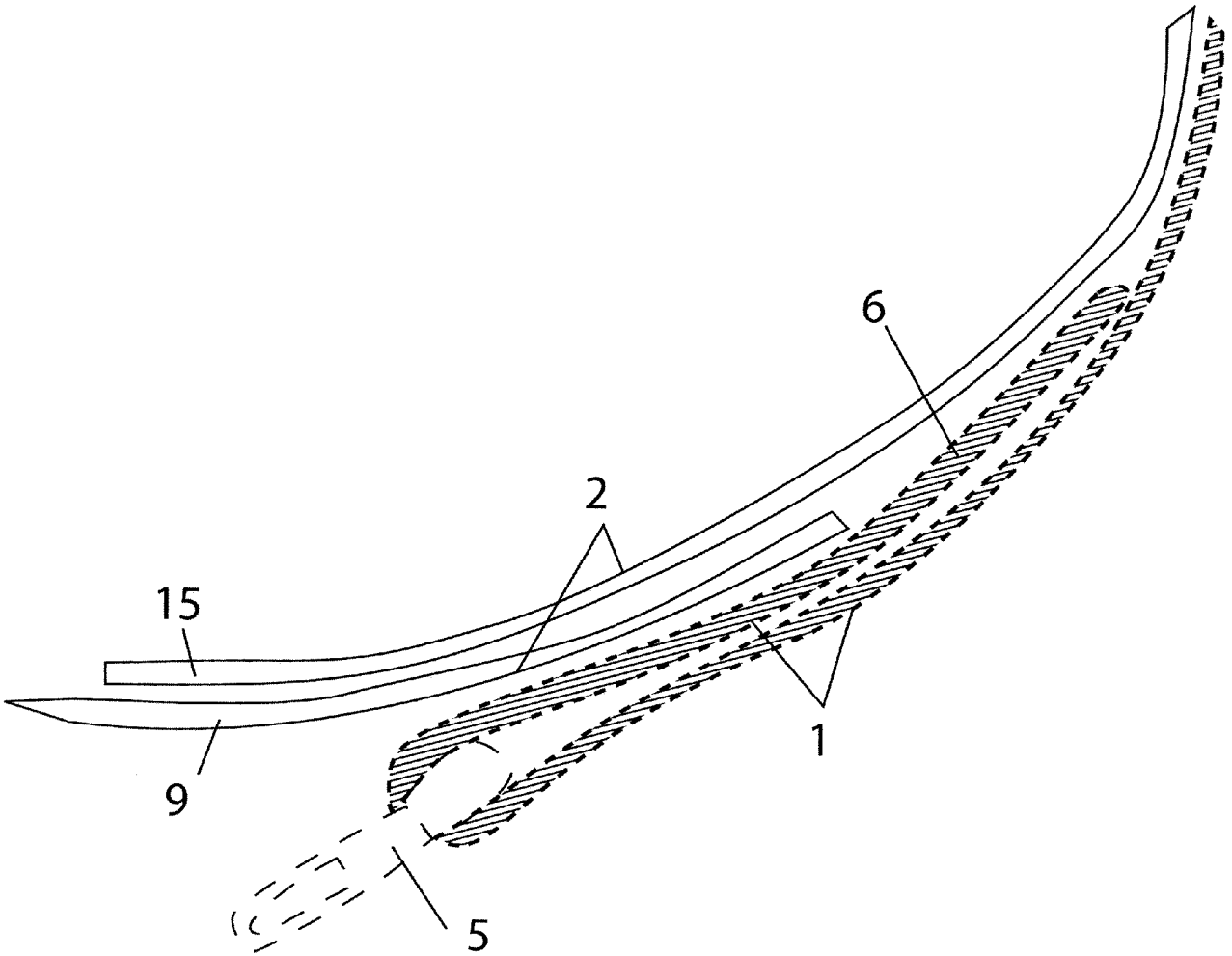
FIG. 5 is a side elevation view of a portion of the supporting belt cohesively affixed to a portion of the inner belt.

Reference is now made concurrently to FIGS. 1, 2 and 5, wherein FIG. 2 shows a perspective view of the supporting belt 14 in accordance with an aspect of the present invention, and FIG. 5 is a side elevation view of a portion of the supporting belt cohesively affixed to a portion of the inner belt. More particularly, FIG. 5 shows the inner belt 12 in a closed position, as it would be around a wearer's waist. The supporting belt 14 may further be equipped with a locking mechanism 18, to fasten the supporting belt 14 around the wearer's waist, over the inner belt 12. The locking mechanism 18 may also function as a mechanism for adjusting a length of the supporting belt 14, as shown on FIG. 2. Alternatively, the locking mechanism may consist of cooperating fabric of the hook and loop fasteners type, applied on both interior and exterior surfaces of the supporting belt 14, and lock the supporting belt 14 by superposing ends of the supporting belt 14. In accordance with a third alternative shown on FIG. 3, and now being concurrently referred to, the locking mechanism 18 may consist of a fast-release buckle as used in airplanes. In all those alternatives, locking mechanisms 18 are simple, reliable, and allow for fast removing of the supporting belt 14.

Figure 4:
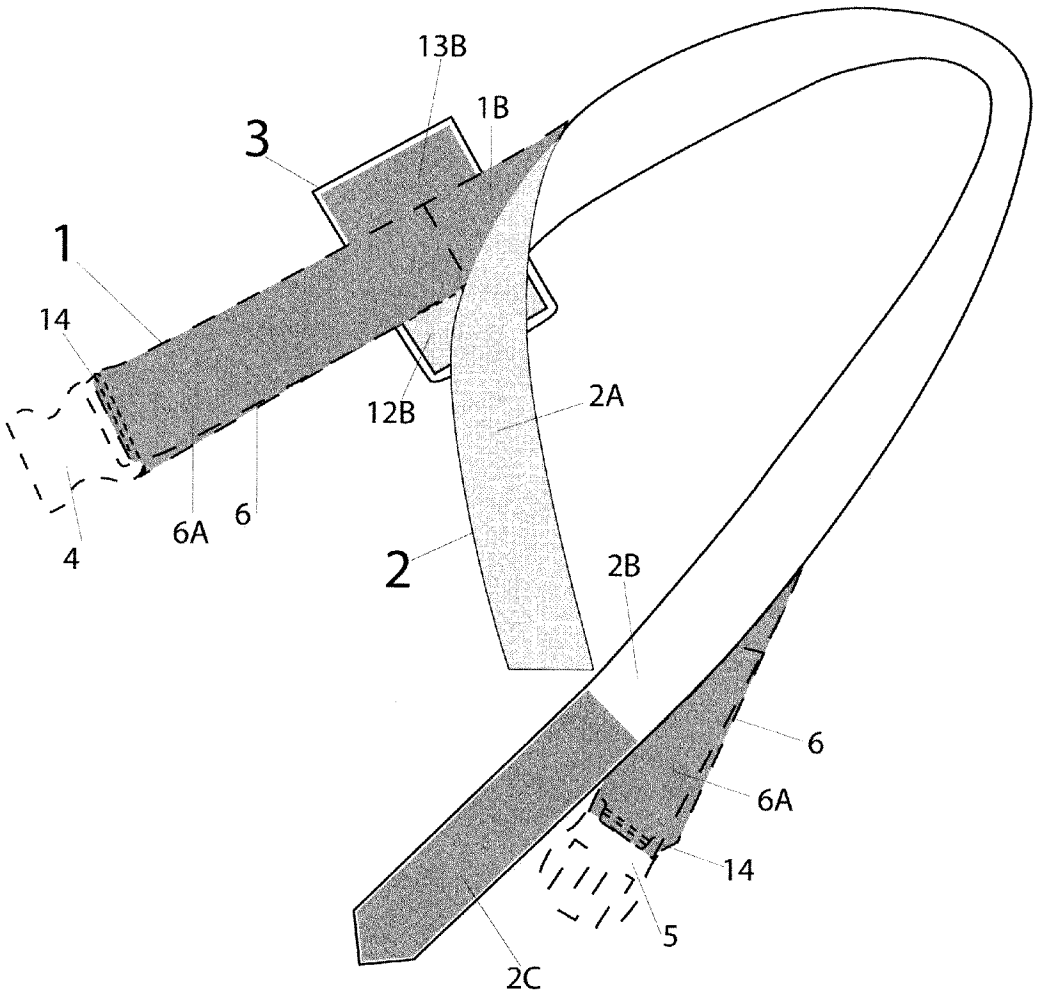
FIG. 4 is a perspective view of the inner belt and supporting belt of the present invention.
Figure 6:
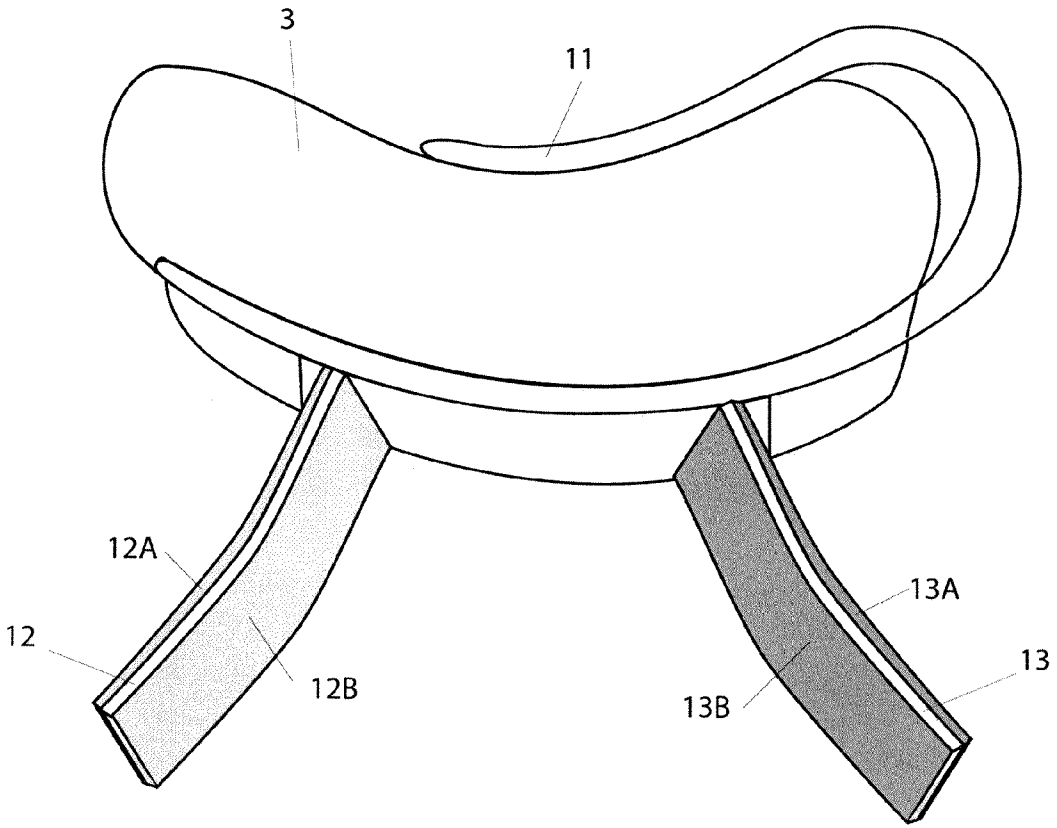
FIG. 6 is a perspective view of a container in accordance with the present invention.

Reference is now concurrently made to FIGS. 1 and 4, wherein FIG. 4 depicts a perspective view of the inner belt 12 partially cohesively affixed to the supporting belt 14, on which a container 16 is also affixed. The container 16 is adapted to be installed by a user on a desired position on the supporting belt 14. As not two users have identical morphological proportions, the possibility of locating the container 16 or multiple containers 16 anywhere on the supporting belt 14 greatly increases user's control flexibility over weight allocation while rendering the belt assembly 10 more ergonomic. Furthermore, the fact that the container 16 affixes to the supporting belt 14 allows for fast release and removal of the belt assembly when needed, without fear of the container 16 sliding out of a position assigned by the wearer. An additional feature of the present invention is depicted on FIG. 6, which shows a perspective view of the container 16 in accordance with an aspect of the invention. The container 16 is adapted to affix to the supporting belt 14 and cohesively affix to the inner belt 12. The container 16 can be specifically designed to receive equipment such as a gun, a flashlight, a pepper spray, a baton, a construction tool, a walkie-talkie, or a mobile telephone.

The container 16 is composed of a receiving compartment 20 for carrying the desired equipment, and a fixating structure 22. The fixating structure 22 is adapted to affix the container 16 to the supporting belt 14. For doing so, the fixating structure 22 may consist for example of complimentary fabric of the hook and loop type, covering a portion of the whole surface 24 of the fixating structure 22, and adapted to be in contact with the supporting belt 14 when the container 16 is affixed thereon. To add rigidity to the container 16, or to provide cushioning to a wearer of the belt assembly, the fixating structure may consist of a dual flap overlapping clamshell system, as shown on FIG. 6. The dual flap system could for example include a superior flap 26 and a lower flap 28. Both superior flap 26 and lower flap 28 are adapted to superpose one another, over the supporting belt 14. Both the superior flap 26 and lower flap 28 could be partially or completely covered with cooperating fabric of the hook and loop type, so as to increase the cohesiveness of the container to the supporting belt 14.

The fixating structure 22 could alternatively be composed of a loop type, and allow sliding of the container 16 onto the supporting belt 14. Other means for affixing the container 16 onto the supporting belt 14 could also be contemplated without departing from the scope of the present invention.

In addition to affixing the container 16 to the supporting belt 14, the fixating structure of the present invention further affixes the container to the inner belt 12, when the supporting belt 14 is in cohesive contact with the latter. For doing so, the fixating structure 22 is further provided with a collaborating fabric of the hook and loop type, located in such a manner that it cohesively affixes to the inner belt 12 when the supporting belt 14 is in cohesive contact with the supporting belt 14. For example, on FIG. 6, the cooperating fabric of the hook and loop type is applied to an exterior surface 30 of the flap that is designed to superpose onto the other flap. By adding cohesiveness between the container 16 and the inner belt 12, the belt assembly 10 becomes intrinsically more ergonomic, and the preferred position of the container chosen by the wearer becomes insensitive to movement of the wearer.

The container 16 could be made of various fabrics: for example leather, high gauge polyester fabric, various gauge of plastic, etc.

The expression "cooperating fabric of the hook and loop type" has been used throughout the present specification to refer to a combination of two fabrics, i.e. a hook type fabric and a corresponding loop type fabric. Those skilled in the art will acknowledge that such cooperation is only possible when complimentary hook and loop fabrics are put in contact. In the context of the present invention, it is immaterial whether a hook fabric or loop type fabric is applied to one surface or another, as long as the cooperation there between is accomplished and respected.

The present invention has been described by way of preferred embodiments. It should be clear to those skilled in the art that the described preferred embodiments are for exemplary purposes only, and should not be interpreted to limit the scope of the present invention. The belt assembly and container as described in the description of preferred embodiments can be modified without departing from the scope of the present invention. The scope of the present invention should be defined by reference to the appended claims, which clearly delimit the protection sought.

The invention claimed is:

1. A work belt assembly for carrying at least several kilograms of equipment, comprising:

a flexible inner belt having a hook and loop fabric covering an entire width of an outer side thereof, and configured to be worn around a wearer's waist, said inner belt being flexible in a lateral direction perpendicular to a longitudinal direction thereof, a flexible outer equipment supporting belt having a width at least as wide as said inner belt, and having a mating hook and loop fabric covering the entire width of an inner side thereof, said outer belt being flexible in a lateral direction perpendicular to a longitudinal direction thereof, and a plurality of equipment container modules for carrying equipment weighing at least several kilograms, each of said container modules having a superior flap and a superposing lower flap, each flap being covered on both sides with hook and loop fabric, and each of said container modules being removably mountable to the outer belt with hook and loop fabric on said superior and lower flaps affixed onto one another, and with hook and loop fabric on one of said flaps affixed onto hook and loop fabric on the outer belt such that all of said one of said flaps attaches to the outer belt, and with hook and loop fabric on the other of said flaps affixed onto hook and loop fabric on the inner belt such that all of said other of said flaps attaches to the inner belt, and said outer belt being removably mountable to the inner belt with hook and loop fabric on the outer belt affixed onto hook and loop fabric on the inner belt, and with hook and loop fabric on the other of said superior and lower flaps of each of said container modules affixed onto hook and loop fabric on the inner belt when the supporting belt is mounted to the inner belt.

2. The belt assembly of claim 1, wherein the outer belt has lateral flexibility but is longitudinally unstretchable.

3. The belt assembly of claim 1, wherein each container module superior flap has a width which is equal to the width of the inner belt, and wherein each container module lower flap has a width equal to the width of the superior flap.

4. The belt assembly of claim 1, wherein the outer belt is made of a woven fabric.

5. The belt assembly of claim 4, wherein the inner belt is dimensioned to pass through garment belt loops around the wearer's waist.

6. The belt assembly of claim 5, wherein at least one of the container modules extends above the outer belt.

7. The belt assembly of claim 5, wherein at least one of the container modules extends below the outer belt.

8. The belt assembly of claim 5, wherein the container modules are adapted to receive at least two of the following: a gun, a baton, pepper spray, and a walkie-talkie.

9. A law enforcement duty belt assembly, comprising:

a flexible inner belt having a hook and loop fabric covering an entire width of an outer side thereof, and configured to be worn around a wearer's waist, said inner belt being flexible in a lateral direction perpendicular to a longitudinal direction thereof, a flexible outer equipment supporting belt having a width at least as wide as said inner belt, and having a mating hook and loop fabric covering a width of an inner side thereof that is co-extensive with the width of the hook and loop fabric on the outer side of the inner belt, said outer belt being flexible in a lateral direction perpendicular to a longitudinal direction thereof, and a plurality of equipment container modules, including a holster for a gun, for carrying equipment weighing at least several kilograms, each of said container modules having a superior flap and a superposing lower flap, each flap being covered on both sides with hook and loop fabric, and each of said container modules being removably mountable to the outer belt with hook and loop fabric on said superior and lower flaps affixed onto one another, and with hook and loop fabric on one of said flaps affixed onto hook and loop fabric on the outer belt, and with hook and loop fabric on one of said flaps affixed onto hook and loop fabric on the inner belt, wherein each container module superior flap has a width which is equal to the width of the inner belt, and wherein each container module lower flap has a width equal to the width of the superior flap, and said outer belt being removably mountable to the inner belt with hook and loop fabric on the outer belt affixed onto hook and loop fabric on the inner belt, and with hook and loop fabric on the other of said superior and lower flaps of each of said container modules affixed onto hook and loop fabric on the inner belt when the outer belt is mounted to the inner belt.

10. The belt assembly of claim 9, wherein the outer belt has lateral flexibility but is longitudinally unstretchable.

11. The belt assembly of claim 9, wherein each of said container modules is removably mountable to the outer belt with hook and loop fabric such that all of said one of said flaps attaches to the outer belt, and such that all of said other of said flaps attaches to the inner belt.

12. The belt assembly of claim 9, wherein the outer belt is made of a woven fabric.

13. The belt assembly of claim 12, wherein the inner belt is dimensioned to pass through garment belt loops around the wearer's waist.

14. The belt assembly of claim 13, wherein at least one of the container modules extends above the outer belt.

15. The belt assembly of claim 13, wherein at least one of the container modules extends below the outer belt.

16. The belt assembly of claim 13, wherein the container modules are adapted to receive at least two of the following: a gun, a baton, pepper spray, and a walkie-talkie.

* * * * *